US008580380B2

(12) United States Patent
Kitagawa et al.

(10) Patent No.: US 8,580,380 B2
(45) Date of Patent: Nov. 12, 2013

(54) POLYBENZAZOLE FIBER AND PYRIDOBISIMIDAZOLE FIBER

(75) Inventors: Tooru Kitagawa, Ohtsu (JP); Kohei Kiriyama, Ohtsu (JP); Seiji Watanuki, Ohtsu (JP); Yoshihiko Teramoto, Ohtsu (JP); Yusuke Shimizu, Ohtsu (JP)

(73) Assignee: Toyo Boseki Kabushiki Kaisha, Osaka (JP)

( * ) Notice: Subject to any disclaimer, the term of this patent is extended or adjusted under 35 U.S.C. 154(b) by 429 days.

(21) Appl. No.: 12/438,230

(22) PCT Filed: Aug. 22, 2007

(86) PCT No.: PCT/JP2007/066235

§ 371 (c)(1),
(2), (4) Date: Feb. 20, 2009

(87) PCT Pub. No.: WO2008/023719

PCT Pub. Date: Feb. 28, 2008

(65) Prior Publication Data

US 2010/0233451 A1 Sep. 16, 2010

(30) Foreign Application Priority Data

Aug. 23, 2006 (JP) ..... 2006-226430
Aug. 23, 2006 (JP) ..... 2006-226431
Aug. 23, 2006 (JP) ..... 2006-226432

(51) Int. Cl.
*B32B 19/00* (2006.01)
*B32B 7/02* (2006.01)
*C08G 73/06* (2006.01)

(52) U.S. Cl.
USPC ..... 428/357; 428/213; 528/423

(58) Field of Classification Search
USPC ..... 428/364, 394, 395; 264/205, 211.17, 264/211.15, 345, 184
See application file for complete search history.

(56) References Cited

U.S. PATENT DOCUMENTS 5,288,452 A * 2/1994 Yabuki ..... 264/345
5,296,185 A 3/1994 Chau et al.
5,385,702 A 1/1995 Mills et al.
5,525,638 A 6/1996 Sen et al.

(Continued)

FOREIGN PATENT DOCUMENTS

JP 08041728 A * 2/1996
JP 8-60437 A 3/1996

(Continued)

OTHER PUBLICATIONS

Raw Translation JP-2006 176617 A.*

(Continued)

*Primary Examiner* — Jennifer Chriss
*Assistant Examiner* — Ricardo E Lopez
(74) *Attorney, Agent, or Firm* — Leydig, Voit & Mayer, Ltd.

(57) ABSTRACT

To provide fibers which retain the excellent heat resistance and flame retardancy inherent in polybenzazole fibers and pyridobisimidazole fibers, have improved post-processability and neither necessitate considerable change in production process conditions nor require a high-temperature and long-time heating treatment. With respect to the polybenzazole fiber and pyridobisimidazole fiber, in an electron diffraction diagram of a surface layer part (from the surface to 1 μm) of the fibers, the fibers containing a crystal present in a state satisfying that S2/S1 is in a prescribed range, wherein S1 is a diffraction peak area derived from a crystal (200) plane and S2 is a diffraction peak area derived from a plurality of other crystal planes along an equatorial direction profile.

11 Claims, 2 Drawing Sheets

(56) References Cited

U.S. PATENT DOCUMENTS

| | | | | |
|---|---|---|---|---|
| 5,674,969 | A | 10/1997 | Sikkema et al. | |
| 5,756,031 | A * | 5/1998 | Tani et al. | 264/203 |
| 5,772,942 | A * | 6/1998 | Teramoto et al. | 264/184 |
| 2006/0083923 | A1 * | 4/2006 | Abe et al. | 428/395 |
| 2006/0280937 | A1 * | 12/2006 | Sikkema et al. | 428/357 |

FOREIGN PATENT DOCUMENTS

| | | | |
|---|---|---|---|
| JP | 9-78350 | A | 3/1997 |
| JP | 3564822 | B2 | 6/2004 |
| JP | 2006176617 | A * | 7/2006 |
| WO | WO 94/25506 | A1 | 11/1994 |

OTHER PUBLICATIONS

Machine Translation of JP-1996 041728 A, Feb. 1996.*
Translation JP 08041728, Feb. 13, 1996.*
Kitagawa et al., *Journal of Polymer Science: Part B: Polymer Physics*, 36: 39-48 (1998).
Japanese Patent Office, International Search Report in International Patent Application No. PCT/JP2007/066235 (Oct. 9, 2007).

* cited by examiner

POLYBENZAZOLE FIBER AND PYRIDOBISIMIDAZOLE FIBER

TECHNICAL FIELD

The present invention relates to a polybenzazole fiber and a pyridobisimidazole fiber, and more specifically, to a polybenzazole fiber and a pyridobisimidazole fiber excellent in cutting of the fiber and post-processability such as forming into felts or the like as compared with conventional a polybenzazole fiber and a pyridobisimidazole fiber and usable and applicable for not only industrial materials but also various kinds of uses based on the heat resistance and flame retardancy of the polybenzazole fiber and pyridobisimidazole fiber.

BACKGROUND ART

As fibers having high strength and high heat resistance, a polybenzazole fibers of polybenzoxazole or polybenzothiazole has been known well and fiber formation of the polymers is described in, for example, Patent Documents 1 and 2.

Patent Document 1: U.S. Pat. No. 5,296,185

Patent Document 2: U.S. Pat. No. 5,385,702

Since a polybenzazole fiber and a pyridobisimidazole fiber have capabilities at the highest level in all aspects such as strength, modulus of elasticity, heat resistance, and flame retardancy among organic fibers, they are applied for various uses owing to these characteristics. However, in an application where the heat resistance and flame retardancy are particularly required, because of high strength and high modulus of elasticity, the fibers are not easy to be cut, inferior in post-processability, and thus desired to have improved post-processability.

As a method for improving the post-processability, a method of considerably decreasing the strength of the fibers is supposed to be possible. As the method of considerably decreasing the strength of polybenzazole fiber and pyridobisimidazole fiber, a method of decreasing the concentrations or molecular weights of the polymer, or a method of heating the fiber at a high temperature for a long time can be considered. However, if the concentrations and molecular weights of the polymer are decreased, problems of worsening an operation property may occur; that is, yarn break tends to be caused easily at the time of spinning, switching loss is caused between common brand production and their production, and a spinning conditions also have to be altered because viscosities of dopes are fluctuated significantly. On the other hand, to heat the fiber at a high temperature for a long time, a high temperature furnace is required and a large quantity of energy is required and thus it is also a problem.

While keeping the excellent heat resistance and flame retardancy of the polybenzazole fiber and pyridobisimidazole fiber, a polybenzazole fiber and pyridobisimidazole fiber with rather much lowered strength are desired and it is desired to develop a polybenzazole fiber and pyridobisimidazole fiber excellent in the post-processability while suppressing occurrence of switching loss as much as possible and causing no problem of worsening the operation property without requiring considerable alteration of the process conditions.

DISCLOSURE OF THE INVENTION

Problems to Be Solved by the Invention

The present invention was made in view of the above-described circumstances, it is an object of the present invention to provide polybenzazole fibers and pyridobisimidazole fibers with improved post-processability while keeping the excellent heat resistance and flame retardancy of the polybenzazole fiber and pyridobisimidazole fiber, that is, to provide the polybenzazole fiber and pyridobisimidazole fiber while suppressing occurrence of switching loss as much as possible and neither requiring considerable alteration of the process conditions nor heating treatment at a high temperature for a long time.

Means for Solving the Problems

The present invention employs the following configurations. That is, (1) a polybenzazole fiber containing a polybenzazole crystal present in a state satisfying that S2/S1 is in a range of 0.1 to 0.8 wherein S1 is a diffraction peak area derived from the crystal (200) plane and S2 is a diffraction peak area derived from the crystal (010) plane and (−210) plane along an equatorial direction profile in an electron diffraction diagram of a surface layer part (from the surface to 1 μm) of the polybenzazole fiber:

(2) the polybenzazole fiber according to the description (1), wherein along an azimuthal profile of an electron diffraction of the (200) plane of the polybenzazole crystal in the surface layer part (from the surface to 1 μm) and a center part of the polybenzazole fiber, a value T calculated by dividing a half width of the diffraction peak of the surface layer part by a half width of the diffraction peak of the center part is in a range of 0.75 to 1.25:

(3) the polybenzazole fiber according to the description (1) or (2), wherein with respect to an apparent crystal size of the (200) plane of the polybenzazole crystal calculated from the electron diffraction profile along the equatorial direction in the surface layer part (from the surface to 1 μm) and an electron diffraction profile along the equatorial direction in a center part of the polybenzazole fiber, a value U calculated by dividing the apparent crystal size of the surface layer part by the apparent crystal size of the center part is in a range of 0.75 to 1.25:

(4) the polybenzazole fiber according to the descriptions (1) to (3), wherein with respect to an apparent crystal size of the (010) plane of the polybenzazole crystal calculated from the electron diffraction profile along the equatorial direction in the surface layer part (from the surface to 1 μm) and an electron diffraction profile along the equatorial direction in a center part of the polybenzazole fiber, a value V calculated by dividing the apparent crystal size of the surface layer part by the apparent crystal size of the center part is in a range of 0.75 to 1.25:

(5) the polybenzazole fiber according to one of the descriptions (1) to (4), wherein a cross-section of the polybenzazole fiber is composed of a sheath layer and a core layer distinguished by an optical microscope and a ratio R (%) of an average diameter $r_2$ of the core layer to a diameter $r_1$ of the entire cross-section of the fiber is 90% or lower:

(6) a pyridobisimidazole fiber containing a pyridobisimidazole crystal present in a state satisfying that S2/S1 is in a range of 0.1 to 1.5 wherein S1 is a diffraction peak surface area derived from a crystal (200) plane and S2 is a diffraction peak surface area derived from a crystal (110) plane, (210) plane, and (400) plane along an equatorial direction profile in an electron diffraction diagram of a surface layer part (from the surface to 1 μm) of the pyridobisimidazole fibers: and (7) the pyridobisimidazole fiber according to the description (6), wherein along an azimuthal profile of the electron diffraction of the (200) plane of the pyridobisimidazole crystal in the surface layer part (from the surface to 1 μm) and a center part of pyridobisimidazole fiber, a value T calculated by dividing a half width of the diffraction peak of the surface layer part by a half width of the diffraction peak of the center part is in a range of 0.75 to 1.25.

Effect of the Invention

With respect to a polybenzazole fiber and pyridobisimidazole fiber of the present invention, in the case where the electron diffraction diagrams of their crystals are measured by electron diffractometry, the fiber show characteristic patterns which have been never known in conventional ones. That is, a selective orientation at least in the a, b axes direction of the crystal in the fiber surface layer part is more random than that before and an orientation difference of the crystals in the surface layer part and the center part of the fiber is more narrowed and as a whole of the fiber, the crystal orientation becomes random as compared with those of conventional ones. Accordingly, the fiber strength is lowered and the post-processability of the polybenzazole fiber is improved. Further, the residual strain in the fiber inside is lessened and therefore an effect to suppress fibrillation can be caused.

Figure 1:
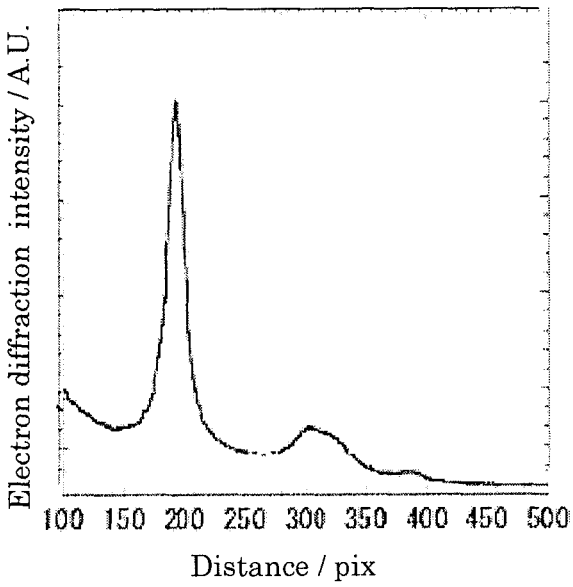
FIG. 1 is one example of selected area electron diffraction diagram of equatorial direction profile of a surface layer part (from the surface to 1 μm) of a polybenzazole fiber of the present invention.
Figure 2:
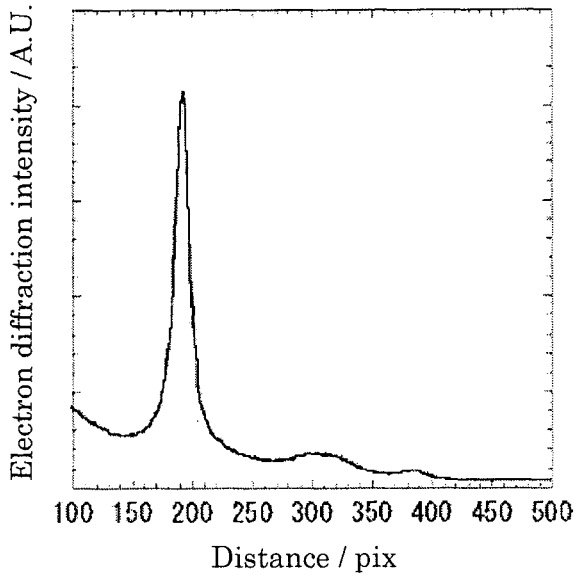
FIG. 2 is one example of selected area electron diffraction diagram of equatorial direction profile of a surface layer part (from the surface to 1 μm) of a polybenzazole fiber of a comparative example.
Figure 3:
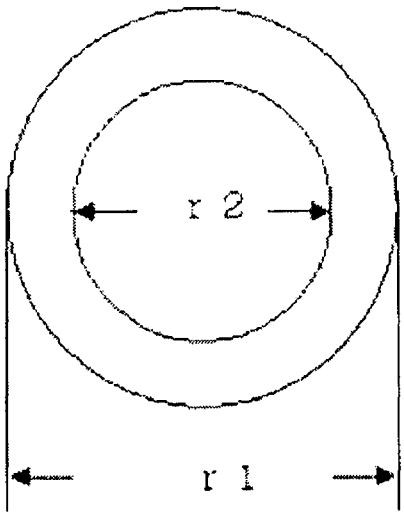
FIG. 3 is a schematic explanatory view showing one example of a sheath/core of a cross-section of a polybenzazole fiber of the present invention.
Figure 4:
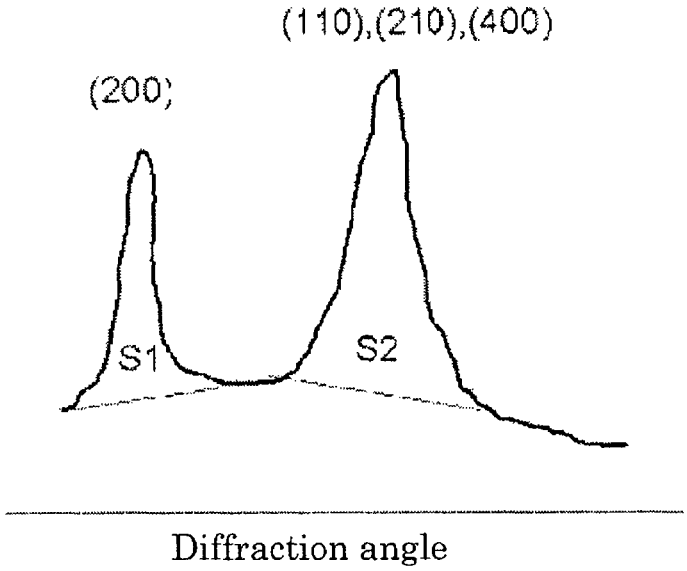
FIG. 4 is one example of selected area electron diffraction diagram of equatorial direction profile of a pyridobisimidazole fiber of the present invention.

EXPLANATION OF SYMBOLS $r_1$: Diameter of a fiber cross-section
$r_2$: Diameter of a core layer

BEST MODE FOR CARRYING OUT THE INVENTION

Hereinafter, the present invention will be described in detail.

A Polybenzazole fiber of the present invention means a fiber of polybenzazole polymer and polybenzazole (hereinafter, referred to as PBZ) means one or more kinds of polymers selected from polybenzoxazole (hereinafter, referred to as PBO), polybenzothiazole (hereinafter, referred to as PBT), and polybenzimidazole (hereinafter, referred to as PBI). In the present invention, PBO means polymer containing an oxazole ring bonded to an aromatic group and the aromatic group is not necessarily required to be benzene ring and may be biphenylene, naphthylene, and the like. PBO means polymer containing an oxazole ring bonded to an aromatic group and the aromatic is not necessarily required to be benzene ring. Further, PBO widely includes not only a homopolymer of phenylene groups of poly(p-phenylenebenzobisoxazole), but also a copolymer in which a part of phenylene groups of poly(p-phenylenebenzobisoxazole) are substituted with a heteroring such as a pyridine ring and a polymer made of an unit of a plurality of oxazole rings bonded to aromatic groups. That is also same for the cases of PBT and PBI. Further, mixtures of two or more of PBO, PBT, and PBI, block copolymers and random copolymers of two or more of PBO, PBT, and PBI, mixtures of these polybenzazole polymers, and copolymers and block polymers are also included.

A structural unit included in the PBZ polymer is, preferably, selected from lyotropic liquid crystal polymer forming liquid crystal at specified concentrations. The polymer is composed of the monomer units having structural formulae (a) to (h) and preferably composed of the monomer units substantially selected from the structural formulae (a) to (d). With respect to these monomer units, the monomer units partially having substituent such as an alkyl group, a halogen group, or the like may be included.

(a)

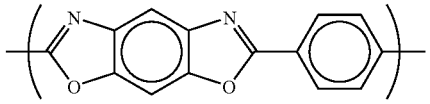

(b)

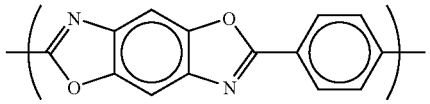

(c)

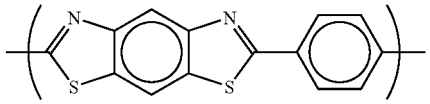

(d)

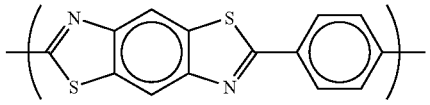

(e)

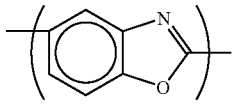

(f)

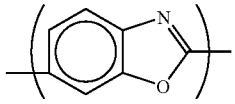

(g)

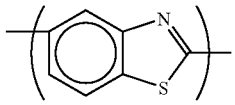

(h)

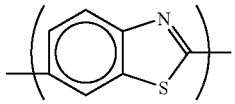

The fiber of the present invention means fibers composed of pyridobisimidazole and consist of at least 50% of repeating units of pyridobisimidazole-2,6-diyl(2,5-dihydroxy-p-phenylene) in and on the other hand, with respect to the remaining units, 2,5-dihydroxy-p-phenylene is substituted with an (un) substituted arylene and/or pyridobisimidazole is substituted with benzobisimidazole, benzobisthiazole, benzobisoxazole, pyridobisthiazole and/or pyridobisoxazole. In this case, at least 75% of the repeating units is a preferably ladder polymer produced by using pyridobisimidazole-2,6-diyl(2,5-dihydroxy-p-phenylene) and on the other hand, with the remaining units, 2,5-dihydroxy-p-phenylene is substituted with an (un)substituted arylene and/or pyridobisimidazole is substituted with benzobisimidazole, benzobisthiazole, benzobisoxazole, pyridobisthiazole and/or pyridobisoxazole. In the case where 2,5-dihydroxy-p-phenylene groups are partially substituted (at most to 50%), compounds remaining after removal of the carboxyl groups of arylenedicarboxylic acid, e.g. isophthalic acid, terephthalic acid, 2,5-pyridinedicarboxylic acid, 2,6-naphthalenedicarboxylic acid, 4,4'-diphenyldicarboxylic acid, 2,6-quinolinedicarboxylic acid, and 2,6-bis(4-carboxyphenyl)pyridobisimidazole.

A structural unit of pyridobisimidazole-2,6-diyl(2,5-dihydroxy-p-phenylene) is shown by structural formula (3).

(3)

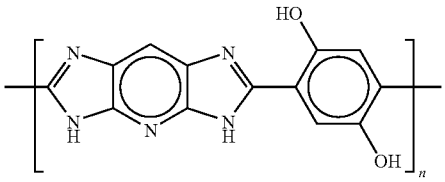

The polybenzazole fiber of the present invention is preferable to satisfy that S2/S1 is in a range of 0.1 to 0.8 wherein S1 is a diffraction peak area derived from the crystal (200) plane and S2 is a diffraction peak area derived from the crystal (010) plane and the (−210) plane along the equatorial direction profile in an electron diffraction diagram of a polybenzazole crystal obtained in a surface layer part (from the surface to 1 μm). S2/S1 is further preferably in a range of 0.11 to 0.78. S2/S1 is furthermore preferably in a range of 0.13 to 0.77. A Polybenzazole has a structure made of azole ring and p-phenylene ring arranged in a manner that the respective ring planes are continued in parallel. Control of an arrangement manner of the rings in the fiber cross-section is relevant to improvement of the post-processability. That is, the present invention increased the cutting easiness of fibers by making at least a selective orientation of the fiber surface layer part, which considerably affects the cutting easiness of the fiber, random. In the present invention, the arrangement manner of the rings in the fiber structure is specified and numeralized as an index of S2/S1. If S2/S1 is in a range of 0.1 to 0.8, fiber strength sufficient for practical use can be obtained and the fiber easy to be cut and provided with excellent post-processability, workability, and line passing property can be obtained.

A reason is the same as the reasons for the above-mentioned the polybenzazole fiber, and it is preferable that the pyridobisimidazole fiber of the present invention satisfy S2/S1 in a range of 0.1 to 1.5 wherein S1 is a diffraction peak area derived from the crystal (200) plane and S2 is the diffraction peak area derived from the crystal (110) plane, (210) plane, and (400) plane along the equatorial direction profile in an electron diffraction diagram of a surface layer part (from the surface to 1 μm) of a polybenzazole crystal. S2/S1 is more preferably in a range of 0.12 to 1.45 and furthermore preferably in a range of 0.13 to 1.4.

Further, along an azimuthal profile of the electron diffraction of the (200) plane of the polybenzazole crystal in the surface layer part (from the surface to 1 μm) and the center part of the polybenzazole fibers and pyridobisimidazole fibers, the value T calculated by dividing the half width of the diffraction peak of the surface layer part by the half width of the diffraction peak of the center part is preferably in a range of 0.75 to 1.25. While the selective orientation is made random, the crystal size is made even, so that fibers excellent in the balance of fiber cutting easiness and strength can be obtained. That is, if the T value is in a range of 0.75 to 1.25, fibers excellent in the balance of fiber cutting easiness and strength can be obtained. The T value is more preferably in a range of 0.76 to 1.25 and furthermore preferably in a range of 0.77 to 1.2.

Furthermore, with respect to the apparent crystal size of the (200) plane of the polybenzazole crystal and pyridobisimidazole crystal calculated from the electron beam diffraction profile along the equatorial direction in the surface layer part (from the surface to 1 μm) and a center part of the polybenzazole fiber and pyridobisimidazole fiber, the polybenzazole fiber and pyridobisimidazole fiber are preferable to have a value U calculated by dividing an apparent crystal size of the surface layer part by an apparent crystal size of the center part in a range of 0.75 to 1.25. It is because the selective orientation is made random and at the same time the crystal size is made even and therefore, fibers excellent in the balance of fiber cutting easiness and strength can be obtained. The value U is more preferably in a range of 0.75 to 1.15 and furthermore preferably in a range of 0.76 to 1.09.

Further, with respect to the apparent crystal size of the (010) plane of the polybenzazole crystal calculated from the electron diffraction profile along the equatorial direction in the surface layer part (from the surface to 1 μm) and the center part of polybenzazole fiber, a value V calculated by dividing the apparent crystal size of the surface layer part by the apparent crystal size of the center part is preferably in a range of 0.75 to 1.25. The value V is more preferably in a range of 0.76 to 1.23. If it exceeds 1.25, the strength decrease of the fiber is sometimes insufficient and on the other hand, if it exceeds 1.25, the strength decrease of the fiber becomes so significant to worsen the workability and line passing property in some cases.

With respect to the polybenzazole fiber and pyridobisimidazole fiber of the present invention, to obtain diffraction diagrams and analysis results by analysis methods of electron diffractometry, conventionally known methods can be employed and the fibers employed for measurement are ultrathin sections with a thickness of about 70 nm including the surface layer part and the center part of the fiber along the fiber axial (longitudinal) direction.

That is, a single fiber is embedded with an epoxy resin produced by Luft method (J. Biophys. Biochem. Cytol., 9, 409 (1961)) and left overnight in an oven at 60° C. for solidification and fixation to obtain a resin block embedding the fiber. Next, the resin block is attached to Ultramicrotome manufactured by REICHERT Co. and polished with a glass knife until the fiber appears in a surface periphery of the block and successively cut along the direction parallel to the fiber axial direction of the single fiber with a diamond knife manufactured by Diatome Co.

For example, in the case where the diameter of the single fiber is 10 μm, if the ultrathin sections with a thickness of about 70 nm are cut continuously from the fiber surface, the fiber can be divided into about 140 pieces. All of the sections obtained by cutting are selectively recovered on a copper grid in a form of groups each containing 10 pieces in the cutting order. The 10 pieces from the starting of cutting is named as Group 1 and successively, Group 1, Group 2, Group n are named. In the case where n of Groups is an even number, the (n/2)th Group or in the case where n is an odd number, the (n/2-0.5)th Group is supplied to the selected area electron diffraction measurement. If one single fiber is cut entirely to the ultrathin sections with approximately same thickness, the fiber pieces of the above-mentioned Group include both of the surface layer part (surface) and the center part of the fiber.

After the ultrathin sections having a thickness of about 70 nm and including both of the surface layer part (surface) and the center part of the fiber are produced, the obtained ultrathin sections are recovered on a copper grid with 300 meshes and carbon vapor deposition is carried out. In addition, the center part in the present invention means a portion including a part regarded to be the center point in the case where the cross-section of the fiber is considered to be circle and means the core part with a diameter of several micro-meter and in the case of the ultrathin sections, the middle part between both the surfaces.

Next, the ultrathin sections are brought in an electron microscope and selected area electron diffraction images of both of the surface layer part and the center part of the fiber are photographed (in this case, the diameter of the selected area (aperture) is controlled to be 1 μm or less and a portion free from artifacts (e.g. wrinkles and tearing of the piece) caused at the time of cutting the fiber into ultrathin sections is selected for the diffraction image photographing portion) to obtain an electron diffraction diagram.

The profile along the equatorial direction of the obtained electron diffraction diagram of the polybenzazole is approximated by Lorentz function and an integrated strength (area) and half widths of the diffraction peaks of (200), (010), and (−210) are calculated and accordingly S2/S1 is calculated, wherein S1 is the area of (200) and S2 is the total area of (010) and (−210).

Further, an apparent crystal size (ACS) is calculated by the following expression.

$$ACS=0.9\lambda/\beta/\cos\theta$$

Herein, λ is the wavelength of an electron beam; β is the half width (unit is radian); and θ is the half value of diffraction angle 2θ.

The profile along the equatorial direction of the obtained electron diffraction diagram of the pyridobisimidazole is approximated by Lorentz function and an integrated strength (area) and half widths of the diffraction peaks of (200), (110), (210), and (400) are calculated and accordingly S2/S1 is calculated, wherein S1 is the area of (200) and S2 is the total area of (110), (210), and (400).

Further, an apparent crystal size (ACS) is calculated by the following expression.

$$ACS=0.9\lambda/\beta/\cos\theta$$

Herein, λ, is the wavelength of an electron beam; β is the half width (unit is radian); and θ is the half value of diffraction angle 2θ.

With respect to the (200) diffraction, the diffraction profile along the azimuthal direction is approximated by Lorentz function and the half width is calculated.

With respect to the polybenzazole fiber and pyridobisimidazole fiber of the present invention, a two layer structure of a sheath layer and a core layer is formed, a simple identification can be carried out by observing a fiber cross-section with an optical microscope. That is, the fiber cross-section is cut into a thickness at which an observation with the optical microscope is possible and observed with the optical microscope at 40 times magnification to confirm the boundary of the sheath layer and the core layer as a circular lime. The outside of the circular line is the sheath layer and the inside is the core layer.

In the case where the cutting easiness is considered to be important, it is preferable that a thickness of the sheath layer is as thick as possible and a diameter of the core layer is as small as possible; however in consideration of balance with the fiber strength, the core layer may dare to be left. In the present invention, the average diameter $r_2$ of the core layer and the fiber cross-section diameter $r_1$ are measured and a ratio R (%) $((r_2/r_1)\times100)$ of the average diameter $r_2$ of the core layer to the diameter $r_1$ of the entire cross-section of the fiber is preferably in a range from 0 to 94%. It is more preferably in a range of 0 to 92% and furthermore preferably in a range of 0 to 90%.

The above-mentioned reason for a proper decrease of the strength and an improvement of the post-processability of the polybenzazole fiber and pyridobisimidazole fiber of the present invention is not necessarily clear; however based on the assumption from the electron diffraction diagram of the polybenzazole crystal by the above-mentioned electron diffractometry, it is supposed that the selective orientation in the a, b axial direction of the crystal of at least the fiber surface layer part is made more random than that before and that the orientation difference of the crystal in the surface layer part and the center part of the fiber is more narrowed and as a whole of the fiber, the crystal orientation becomes random as compared with those of conventional ones, accordingly, the fiber strength is lowered and the post-processability of the polybenzazole fiber is improved. Further, a concentration of stress in specific direction is relaxed by the disturbance of selective orientation of the crystal and a residual strain in the fiber inside is lessened and therefore an effect to suppress fibrillation can be caused.

Hereinafter, preferable production examples of the polybenzazole fiber and pyridobisimidazole fiber of the present invention will be described in details.

Suitable solvents for forming a dope of a polymer include non-oxidative acid capable of dissolving cresol and a polymer thereof. Examples of a preferable solvent for forming a dope of a polymer may include polyphosphoric acid, methanesulfonic acid, high concentration sulfuric acid, and their mixtures. More preferable solvents are polyphosphoric acid and methanesulfonic acid. A most preferable solvent is polyphosphoric acid.

The polymer concentration in the dope is preferably at least about 7% by mass and more preferably at least 10% by mass and even more preferably 14% by mass. The maximum concentration is limited in accordance with a practical handling property such as polymer solubility and dope viscosity. Due to these limitation factors, the polymer concentration should not exceed normally 20% by mass.

In the present invention, a preferable polymer or copolymer and a dope may be synthesized by conventionally known methods. For example, methods are described in Wolfe et al., U.S. Pat. No. 4,533,693 (1985.8.6); Sybert et al., U.S. Pat. No. 4,772,678 (1988.9.22); Harris, U.S. Pat. No. 4,847,350 (1989.7.11); and Gregory et al., U.S. Pat. No. 5,089,591 (1992.2.18). Summarized as follows: preferable monomers are reacted in non-oxidizing and dehydrating acidic solution under high stirring and high shearing conditions in non-oxidizing atmosphere by increasing the temperature step by step from about 60° C. to 230° C. or at constant temperature increase ratio.

The dope polymerized in such a manner is supplied to a spinning part and extruded normally at a temperature of 100° C. or higher from a spinneret. The holes of the spinneret are normally arranged in circular state or in lattice-like form in a plurality of rows; however other arrangements are also allowed. A number of the holes is not particularly limited; however it is important for the arrangement of the holes in the spinneret to keep the pore density at which fusion of spun yarn (dope filaments) is not caused.

In order to obtain sufficient spin-draw ratio (SRD) of a spun yarn, a draw zone length sufficient as described in U.S. Pat. No. 5,296,185 is required and it is desired to evenly carry out cooling by cooling air blow in orderly adjusted at a relatively high temperature (not lower than the solidification temperature of the dope and not higher than the spinning temperature). A length (L) of the draw zone is required to be proper for complete the solidification in a non-coagulation gas and determined roughly in accordance with an extruding quantity (Q) of the single hole. To obtain good fiber physical properties, the takeoff stress in the draw zone is desirable to be 2.2 g/dtex or higher on the basis of polymer (as the stress applied only to the polymer).

In the present invention, the polybenzazole or the pyridobisimidazole dope filaments (expanded or non-expanded) obtained in the above-mentioned manner are preferable to be subjected to vapor treatment by positively bringing the filaments into contact with a vapor of a coagulating agent, that is a liquid non-compatible with polybenzazole and pyridobisimidazole before immersing in coagulation bath.

The coagulating agent for polybenzazole and pyridobisimidazole is preferably at least one of water, methanol, ethanol, acetone, and ethylene glycol and in terms of the convenience, water is more preferable.

According to the vapor treatment, since the dope filament is positively brought into contact with a gas (air) containing the vapor of the above-mentioned liquid, it is supposed that the coagulating agent abruptly penetrates and diffuses entirely in the fiber inside of the dope filament and thus something just like coagulation core may be formed in the fiber center part direction. Surprisingly, when the fiber cross-section is observed after fibrillate formation, a boundary supposedly caused because of the difference of a timing of starting the structure formation can be confirmed and thus it is sometime confirmed that so-called double layers expressed as sheath/core are developed. As the coagulating agent penetrates more in the center part, the core layer becomes smaller and finally no boundary line is observed. In addition, with respect to conventional fibers which are not subjected to the vapor treatment, the sheath/core double layer structure cannot be confirmed.

A temperature for the vapor treatment differs in accordance with a type of the coagulating agent; however, in the case of water, a temperature of steam atmosphere or a temperature of steam to be given is preferably 50 to 200° C. and more preferably 60 to 160° C. If it is lower than 50° C., an effect of decreasing the strength becomes slight. On the other hand, if it exceeds 200° C., yarn break frequently occurs and it tends to result in considerable decrease of productivity. In the case of a coagulating agent with the boiling point lower than that of water, the temperature may be lower and in the case of a coagulating agent with the boiling point higher than that of water, the temperature may be higher and the temperature may be properly selected in consideration of the boiling point and a vapor pressure.

A content of a vapor component in an entire gas component in the vapor phase is preferably 50% by mass or higher, more preferably 60% by mass or higher, and even more preferably 70% by mass or higher for shortening the treatment time.

If the vapor phase temperature is too low, a thickness of the sheath layer is not grown and on the contrary, if the temperature is too high, although the sheath/core structure is developed, a temperature of passing filament is increase and thus yarn break tends to be caused frequently. With respect also to the content of the vapor, if it is too low, it becomes difficult to develop the sheath/core structure.

An apparatus for the vapor treatment is not particularly limited if it is capable of promoting the coagulation of at least the surface layer part by bringing the dope filament into contact with the vapor and may be a continuous type, a non-continuous type, a closed type, and a non-closed type.

The filament after having passed the vapor phase is led next to a coagulation (extraction) bath to extract a solvent of the polybenzazole and pyridobisimidazole and completely solidify the filament. The coagulation bath is not particularly limited and any type coagulation bath may be employed. For example, a funnel type, a water bath type, an aspirator type, or a cascade type may be used. In the coagulation bath, the solvent remaining in the filament is extracted to be finally 1% by mass or less, preferably 0.5% by mass or less. A liquid to be used as an extraction medium in the present invention is not particularly limited; however it is preferably water, methanol, ethanol, acetone, ethylene glycol, and the like which substantially have no compatibility with the polybenzazole. As the extraction solution, an aqueous phosphoric acid solution and water are convenient and desirable. Further, a method in which the coagulation (extraction) bath is separated in multi-steps and a concentration of an aqueous phosphoric acid solution is successively diluted and finally washing with water is carried out may be employed. Further, in the coagulation (extraction) step, a method involving washing with water after the filament bundles are neutralized with an aqueous sodium hydroxide solution is a preferable method. After that, drying and heat treatment are carried out to obtain fibers made of distinguishable sheath/core double layers.

Thereafter, the fiber is dried and subjected to heating treatment if necessary. The drying temperature is not particularly limited if the coagulating agent and the solvent of the polybenzazole and pyridobisimidazole are evaporated; however it may be 150 to 400° C., preferably 200 to 300° C., and more preferably 220 to 270° C. In order to improve the modulus of elasticity, heating treatment may be carried out under tension based on the necessity. The heating treatment temperature may be 400 to 700° C., preferably 500 to 680° C., and more preferably 550 to 630° C. The tension to be applied is 0.3 to 1.2 g/dtex, preferably 0.5 to 1.1 g/dtex, and more preferably 0.6 to 1.0 g/dtex.

EXAMPLES

Hereinafter, the present invention will be described further in detail along with Examples; however the present invention should not be limited to these Examples. The following methods were employed for respective measurements.

Measurement Methods:

(Limiting Viscosity)

A viscosity number of a polymer solution adjusted to have a concentration of 0.5 g/l using methanesulfonic acid as a solvent was measured in a thermostat at 25° C. using an Ostwald viscometer.

(Method of Fiber Cross-Section Observation)

A specimen obtained by embedded fibers for measurement with an epoxy resin (G-2, manufactured by GATAN Co.) was argon ion-etched by a cross-section polisher (SM-09010, manufactured by JEOL Co. Ltd.) to obtain a fiber cross-section for observation. Next, the boundary of the core layer and sheath layer was observed by an optical microscope and the average diameter $r_2$ of the core layer and the diameter $r_1$ of the fiber cross-section were measured to calculate the ratio R (%) of the average diameter $r_2$ of the core layer to the diameter $r_1$ of the fiber cross-section.

$$R(\%)=(r_2/r_1)\times 100$$

(Measurement Method of Fiber Strength and Modulus of Elasticity)

After being left for 24 hours or more in an experiment chamber in the standard state (temperature: 20±2° C., relative humidity (RH) 65±2%), a tensile strength and modulus of elasticity of each fiber were measured by a tensile tester according to JIS L 1013.

(Measurement Method of Heat Resistance of Fiber)

Using a thermal gravitational analyzer (TGA Q 50, manufactured by TA Instrument Co.), an evaluation was carried out at a temperature at which a weight retention ratio [(sample weight at a certain temperature)/(sample weight at the beginning)×100] became 90% in the case where the temperature was increased from normal temperature at increasing rate of 20° C./min in air.

(Measurement of Electron Diffraction)

A specimen employed for electron diffraction was an ultrathin section with a thickness of about 70 nm obtained by cutting a fiber for measurement along the fiber axial (longitudinal) direction to include a surface layer part and a center part of the fiber in the following manner.

That is, a single fiber was embedded with an epoxy resin produced by Luft method (J. Biophys. Biochem. Cytol., 9, 409 (1961) and left overnight in an oven at 60° C. for solidification and fixation to obtain a resin block wrapping the fiber.

Next, the resin block was attached to Ultramicrotome manufactured by REICHERT Co. and polished with a glass knife until the fiber appeared in a surface periphery of the block and successively cut along the direction parallel to the fiber axial direction of the single fiber with a diamond knife manufactured by Diatome Co. to obtain ultrathin sections with a thickness of about 70 nm including both of the surface layer part and the center part of the fibers. Next, the obtained ultrathin sections were recovered on a copper grid with 300 mesh and carbon vapor deposition was carried out. Next, the ultrathin sections were brought in an electron microscope and selected area electron diffraction images of both of the surface layer part and the center part of the fiber were photographed (in this case, a diameter of the selected area (aperture) was controlled to be 1 μm or less and a portion free from artifacts (e.g. wrinkles and tearing of the pieces) caused at the time of cutting the fiber into ultrathin section was selected for the diffraction image photographing portion) to obtain an electron diffraction diagram.

A profile along the equatorial direction of the obtained electron diffraction diagram of the polybenzazole was approximated by Lorentz function and an integrated strength (area) and half widths of a diffraction peaks of (200), (010), and (−210) were calculated. S2/S1 was calculated, wherein S1 was the area of (200) and S2 was a total area of (010) and (−210).

Further, an apparent crystal size (ACS) was calculated by the following expression.

$$ACS=0.9\lambda/\beta \cos \theta$$

Herein, λ is the wavelength of an electron beam; β is the half width (unit is radian); and θ is the half value of diffraction angle 2θ.

Further, with respect to the (200) diffraction, the diffraction profile along the azimuthal direction was approximated by Lorentz function and a half width was calculated.

A profile along the equatorial direction of the obtained electron diffraction diagrams of the pyridobisimidazole was approximated by Lorentz function and an integrated strength (surface area) and half widths of the diffraction peaks of (200), (110), (210), and (400) were calculated. S2/S1 is calculated, wherein S1 was the area of (200) and S2 was a total area of (110), (210), and (400).

Further, an apparent crystal size (ACS) was calculated by the following expression.

$$ACS=0.9\lambda/\beta \cos \theta$$

Herein, λ is the wavelength of an electron beam; β is the half width (unit is radian); and θ is the half value of diffraction angle 2θ.

Further, with respect to the (200) diffraction, the diffraction profile along the azimuthal direction was approximated by Lorentz function and a half width was calculated.

(Evaluation Method of Post-Processability)

According to the evaluation fiber buckling crimp by a stuffer crimp method, a fiber was cut in a cut length of 44 mm to obtain staples. The obtained staples were opened by an opener and webs with a weight of 450 g/m$^2$ were obtained by a roller card. Nine sheets of the obtained webs were laminated successively and needle-punched only from one face side of a felt with a needle depth of 7 mm using a needle (product number: 15×18×40×3.5 PB-AF 20 2-18-3B/L1/CC/CONICAL) manufactured by Foster Co. until the number of the needle punching was 2000/cm$^2$ to obtain felt. The number of needles broken (converted into the number per 1 m$^2$ of the finished felt) until the felt was obtained from successively laminating the webs was investigated. As the number of broken was less, the post-processability was better.

(Line Passing Property)

The line passing property was determined in accordance with the occurrence of production troubles in a steps from the spinning to the fiber web production.

(Friction-Charged Electrostatic Potential)

According to JIS L 1094, a frictional withstand voltage was measured. The measurement was carried out using a Friction-charged electrostatic potential measurement apparatus RS-101D manufactured by Daiei Kagaku Seiki MFG. CO. While a specimen was rotated at 400 rpm, the specimen was fractioned by a friction cloth and the electrostatic potential was measured after 60 seconds.

Examples 1 to 6 and Comparative Examples 1 to 3

Using spinning dope (PBO concentration 14% by mass) obtained by dissolving poly(p-phenylenebenzobisoxazole) (hereinafter, abbreviated as PBO) with a limiting viscosity number [η] of 29 dl/g in polyphosphoric acid, spinning was carried out in condition that a single filament diameter became 11.5 μm and 1.65 dtex.

That is the spinning dope was spun from a spinneret having 166 holes with a hole diameter of 0.20 mm at a spinning temperature of 175° C. and the spun dope filaments were quenched by passing them in a quenching chamber at a quenching temperature of 60° C. and after passing the quenching chamber, they were converged into multifilament and immersed in a first coagulation and washing bath to solidify the filaments and at the same time were carried out with vapor treatment in the vapor supply conditions shown in Table 1. Thereafter, obtained filaments were washed with water until the remaining phosphorus concentration in the filaments became 5000 ppm or less and neutralized with an aqueous 1% NaOH solution for 5 seconds and further washed with water for 10 seconds. Thereafter, filaments were dried until the water content was decreased to 2% and wound to obtain fibers for evaluation. In addition, for the post-processability evaluation, backling crimped staples obtained as described above were used.

The analysis results and evaluation results of the respective obtained fiber are shown in Table 1 and Table 2.

TABLE 1

| | Vapor supply conditions | | | | Fiber characteristics | | | | | | | | |
|---|---|---|---|---|---|---|---|---|---|---|---|---|---|
| | Steam temperature | Application method | Application time | Spinning filament cutting | Tensile strength | Tensile modulus of elasticity | Heat resistance | Flame retardancy | Core ratio R | Electron diffraction evaluation results of fibers | | | |
| | ° C. | % | Second | state | GPa | GPa | ° C. | LOI | % | S2/S1 | T | U | V |
| Example 1 | 120 | Atmosphere | 0.6 | No problem | 3.2 | 138 | 670 | 68 | 0 | 0.77 | 1.21 | 1.2 | 1.21 |
| Example 2 | 75 | Atmosphere | 0.6 | No problem | 3.7 | 153 | 660 | 65 | 31 | 0.37 | 0.82 | 0.86 | 0.87 |
| Example 3 | 75 | Atmosphere | 0.3 | No problem | 3.5 | 149 | 670 | 66 | 51 | 0.49 | 0.91 | 0.97 | 0.96 |
| Example 4 | 75 | Atmosphere | 10 | No problem | 3.2 | 132 | 670 | 68 | 13 | 0.21 | 0.77 | 0.76 | 0.77 |
| Example 5 | 120 | Atmosphere | 0.03 | No problem | 3.5 | 130 | 680 | 64 | 72 | 0.63 | 1.04 | 1.07 | 1.09 |
| Example 6 | 120 | Spraying | 0.6 | No problem | 3.6 | 140 | 660 | 66 | 86 | 0.13 | 1.14 | 1.09 | 1.13 |
| Comparative Example 1 | None | None | None | No problem | 6 | 181 | 670 | 68 | 100 | 0.03 | 0.7 | 1.31 | 1.34 |
| Comparative Example 2 | 40 | Atmosphere | 0.6 | No problem | 5.3 | 168 | 660 | 65 | 95 | 0.05 | 0.73 | 1.28 | 1.27 |
| Comparative Example 3 | 200 | Atmosphere | 0.6 | Filament cutting frequently occurred | 2.3 | 106 | 680 | 62 | 0 | 0.86 | 1.29 | 0.72 | 0.71 |

The fibers described in Examples 1 to 6 according to the present invention and the fibers described in Comparative Examples 1 and 2 were spun without a problem of filament break. On the other hand, the fiber described in Comparative Example 3 was severely broken.

TABLE 2

| | Weight of felt (g/m$^2$) | Thickness of felt (mm) | Number of broken needles (number/m$^2$) | Line passing property (occurrence of problems) |
|---|---|---|---|---|
| Example 1 | 3600 | 9.5 | 60 | No problem |
| Example 2 | 3700 | 9.4 | 70 | No problem |
| Example 3 | 3600 | 9.7 | 50 | No problem |
| Example 4 | 3800 | 10 | 50 | No problem |
| Example 5 | 3600 | 9.4 | 60 | No problem |
| Example 6 | 3500 | 9.5 | 60 | No problem |
| Comparative Example 1 | 3500 | 9.7 | 380 | Problems occurred |
| Comparative Example 2 | 3600 | 9.5 | 340 | Problems occurred |
| Comparative Example 3 | 3600 | 9.7 | 30 | No problem |

With respect to the fibers described in Examples 1 to 6 described in the present invention, the number of broken needles was remarkably small and the line passing property was good. On the other hand, the fibers described in Comparative Examples 1 and 2 were free from the fiber break problem at the time of spinning as described above; however needle breaking often occurred at the time of felt production and thus the fibers were inferior in the productivity of the felt. Further, the fiber described in Comparative Example 3 was free from the problem at the time of felt production; however the problem of fiber break in the spinning step was significant and thus the fiber was inferior in the industrial productivity.

Examples 7 to 12 and Comparative Examples 3 to 6

Using spinning dope (pyridobisimidazole-2,6-diyl(2,5-dihydroxy-p-phenylene) concentration 14% by mass) obtained by dissolving pyridobisimidazole-2,6-diyl(2,5-dihydroxy-p-phenylene) with a limiting viscosity number [η] of 22 dl/g in polyphosphoric acid, spinning was carried out in condition that a single filament diameter became 11.5 μm and 1.65 dtex.

That is, the spinning dope was spun from a spinneret having 166 holes with a hole diameter of 0.20 mm at a spinning temperature of 175° C. and the spun dope filaments were quenched by passing them in a quenching chamber at a quenching temperature of 60° C. and after passing the quenching chamber, they were converged into multifilament and immersed in a first coagulation and washing bath to solidify the filaments and at the same time were carried out with vapor treatment in the vapor supply conditions shown in Table 1. Thereafter, obtained filaments were washed with water until the remaining phosphorus concentration in the filaments became 5000 ppm or less and neutralized with an aqueous 1% NaOH solution for 5 seconds and further washed with water for 10 seconds. Thereafter, filaments were dried until the water content was decreased to 2% and wound to obtain fibers for evaluation. In addition, for the post-processability evaluation, backling crimped staples obtained as described above were used.

The analysis results and evaluation results of the respective obtained fibers are shown in Table 3 and Table 4.

TABLE 3

| | Vapor supply conditions | | | | Fiber characteristics | | | | | | |
|---|---|---|---|---|---|---|---|---|---|---|---|
| | Steam temperature | Application method | Application time | Spinning filament cutting | Tensile strength | Tensile modulus of elasticity | Heat resistance | Flame retardancy | Core ratio R | Electron diffraction evaluation results of fibers | |
| | ° C. | % | Second | state | GPa | GPa | ° C. | LOI | % | S2/S1 | T |
| Example 7 | 120 | Atmosphere | 0.6 | No problem | 2.9 | 139 | 640 | 51 | 0 | 1.4 | 1.2 |
| Example 8 | 75 | Atmosphere | 0.6 | No problem | 3.6 | 161 | 620 | 49 | 30 | 0.57 | 0.83 |
| Example 9 | 75 | Atmosphere | 0.3 | No problem | 3.1 | 144 | 620 | 53 | 52 | 0.84 | 9.92 |
| Example 10 | 75 | Atmosphere | 10 | No problem | 3 | 131 | 630 | 48 | 12 | 0.29 | 0.76 |
| Example 11 | 120 | Atmosphere | 0.03 | No problem | 2.9 | 150 | 660 | 54 | 70 | 0.98 | 1.05 |
| Example 12 | 120 | Spraying | 0.6 | No problem | 3.4 | 141 | 620 | 53 | 89 | 0.13 | 1.13 |
| Comparative Example 4 | None | None | None | No problem | 5.1 | 169 | 660 | 57 | 100 | 0.03 | 0.71 |
| Comparative Example 5 | 40 | Atmosphere | 0.6 | No problem | 4.9 | 153 | 630 | 51 | 95 | 0.05 | 0.73 |
| Comparative Example 6 | 200 | Atmosphere | 0.6 | Filament cutting frequently occurred | 1.7 | 98 | 660 | 47 | 0 | 1.61 | 1.28 |

The fibers described in Examples 7 to 12 according to the present invention and the fibers described in Comparative Examples 4 and 5 were spun without a problem of filament break. On the other hand, the fiber described in Comparative Example 6 was severely broken.

TABLE 4

| | Weight of felt (g/m$^2$) | Thickness of felt (mm) | Number of broken needles (number/m$^2$) | Line passing property (occurrence of problems) |
|---|---|---|---|---|
| Example 7 | 3600 | 9.5 | 70 | No problem |
| Example 8 | 3700 | 9.5 | 80 | No problem |
| Example 9 | 3700 | 9.7 | 60 | No problem |
| Example 10 | 3800 | 10 | 50 | No problem |
| Example 11 | 3600 | 9.3 | 60 | No problem |
| Example 12 | 3600 | 9.5 | 90 | No problem |
| Comparative Example 4 | 3500 | 9.6 | 420 | Problems occurred |
| Comparative Example 5 | 3600 | 9.5 | 350 | Problems occurred |
| Comparative Example 6 | 3600 | 9.8 | 40 | No problem |

With respect to the fibers described in Examples 7 to 12 according to the present invention, the number of broken needles was remarkably small and the line passing property was good. On the other hand, the fibers described in Comparative Examples 4 and 5 were free from the fiber break problem at the time of spinning as described above; however needle breaking often occurred at the time of felt production and thus the fibers were inferior in the productivity of the felt. Further, the fiber described in Comparative Example 6 was free from the problem at the time of felt production; however the problem of fiber break in the spinning step was significant and thus the fiber was inferior in the industrial productivity.

Example 13

The fiber produced in Example 1 was subjected to heating treatment with a tensile force of 5.0 g/d and a temperature of 600° C. for 2.4 seconds. The results are shown in Table 5 and Table 6.

TABLE 5

| | Vapor supply conditions | | | | Fiber characteristics | | | | | | | | |
|---|---|---|---|---|---|---|---|---|---|---|---|---|---|
| | Steam temperature | Application method | Application time | Spinning filament cutting | Tensile strength | Tensile modulus of elasticity | Heat resistance | Flame retardancy | Core ratio R | Electron diffraction evaluation results of fibers | | | |
| | ° C. | % | Second | state | GPa | GPa | ° C. | LOI | % | S2/S1 | T | U | V |
| Example 13 | 120 | Atmosphere | 0.6 | No problem | 3.1 | 261 | 670 | 68 | 0 | 0.77 | 1.21 | 1.2 | 1.21 |

From the results of Table 5, the fiber of the present invention was found retaining excellent heat resistance and flame retardancy.

TABLE 6

| | Weight of felt (g/m$^2$) | Thickness of felt (mm) | Number of broken needles (number/m$^2$) | Line passing property (occurrence of problems) |
|---|---|---|---|---|
| Example 13 | 3600 | 9.5 | 60 | No problem |

As shown in Table 6, the fiber of the present invention was found retaining good line passing property even if heating treatment was carried out.

Example 14

The fiber produced in Example 7 was subjected to heating treatment with a tensile force of 5.0 g/d and a temperature of 600° C. for 2.4 seconds. The results are shown in Table 7 and Table 8.

TABLE 7

| | Vapor supply conditions | | | | Fiber characteristics | | | | | Electron diffraction evaluation results of fibers | |
|---|---|---|---|---|---|---|---|---|---|---|---|
| | Steam temperature | Application method | Application time | Spinning filament cutting | Tensile strength | Tensile modulus of elasticity | Heat resistance | Flame retardancy | Core ratio R | | |
| | ° C. | % | Second | state | GPa | GPa | ° C. | LOI | % | S2/S1 | T |
| Example 14 | 120 | Atmosphere | 0.6 | No problem | 2.8 | 256 | 640 | 51 | 0 | 1.4 | 1.2 |

From the results of Table 7, the fiber of the present invention was found retaining excellent heat resistance and flame retardancy.

TABLE 8

| | Weight of felt (g/m$^2$) | Thickness of felt (mm) | Number of broken needles (number/m$^2$) | Line passing property (occurrence of problems) |
|---|---|---|---|---|
| Example 14 | 3600 | 9.5 | 70 | No problem |

As shown in Table 8, the fiber of the present invention was found retaining good line passing property even if heating treatment was carried out.

The polybenzazole fiber and pyridobisimidazole fiber obtained according to the present invention retain the excellent heat resistance and flame retardancy although the fiber strength was decreased and accordingly the fibers were found excellent in the post-processability as compared with conventional polybenzazole fibers.

INDUSTRIAL APPLICABILITY

The polybenzazole fiber and pyridobisimidazole fiber of the present invention are improved in the post-processability as compared with conventional ones and thus made easy for application and development for various uses requiring heat resistance and flame retardancy as important characteristics and greatly contribute to industrial fields.

The invention claimed is:

1. A polybenzazole fiber containing a polybenzazole crystal present in a state satisfying that S2/S1 is in a range of 0.21 to 0.8 wherein S1 is a diffraction peak area derived from the crystal (200) plane and S2 is a diffraction peak area derived from the crystal (010) plane and (−210) plane along an equatorial direction profile in an electron diffraction diagram of a surface layer part from the surface to 1 μm of the polybenzazole fiber.

2. The polybenzazole fiber according to claim 1, wherein along an azimuthal profile of an electron diffraction of the (200) plane of the polybenzazole crystal in the surface layer part from the surface to 1 μm and a center part of the polybenzazole fiber, a value T calculated by dividing a half width of the diffraction peak of the surface layer part by a half width of the diffraction peak of the center part is in a range of 0.75 to 1.25.

3. The polybenzazole fiber according to claim 1, wherein with respect to an apparent crystal size of the (200) plane of the polybenzazole crystal calculated from the electron diffraction profile along the equatorial direction in the surface layer part from the surface to 1 μm and an electron diffraction profile along the equatorial direction in a center part of the polybenzazole fiber, a value U calculated by dividing the apparent crystal size of the surface layer part by the apparent crystal size of the center part is in a range of 0.75 to 1.25.

4. The polybenzazole fiber according to any one of claim 1, wherein with respect to an apparent crystal size of the (010) plane of the polybenzazole crystal calculated from the electron diffraction profile along the equatorial direction in the surface layer part from the surface to 1 μm and an electron diffraction profile along the equatorial direction in a center part of the polybenzazole fiber, a value V calculated by dividing the apparent crystal size of the surface layer part by the apparent crystal size of the center part is in a range of 0.75 to 1.25.

5. The polybenzazole fiber according to claim 1, wherein a cross-section of the polybenzazole fiber is composed of a sheath layer and a core layer distinguished by an optical microscope and a ratio R (%) of an average diameter $r_2$ of the core layer to a diameter $r_1$ of the entire cross-section of the fiber is 90% or lower.

6. A pyridobisimidazole fiber containing a pyridobisimidazole crystal present in a state satisfying that S2/S1 is in a range of 0.29 to 1.5 wherein S1 is a diffraction peak area derived from a crystal (200) plane and S2 is a diffraction peak area derived from a crystal (110) plane, (210) plane, and (400) plane along an equatorial direction profile in an electron diffraction diagram of a surface layer part from the surface to 1 μm of the pyridobisimidazole fiber.

7. The pyridobisimidazole fiber according to claim 6, wherein along an azimuthal profile of the electron diffraction of the (200) plane of the pyridobisimidazole crystal in the surface layer part from the surface to 1 μm and a center part of pyridobisimidazole fiber, a value T calculated by dividing a half width of the diffraction peak of the surface layer part by a half width of the diffraction peak of the center part is in a range of 0.75 to 1.25.

8. The polybenzazole fiber according to claim 2, wherein with respect to an apparent crystal size of the (200) plane of the polybenzazole crystal calculated from the electron diffraction profile along the equatorial direction in the surface layer part from the surface to 1 μm and an electron diffraction profile along the equatorial direction in a center part of the polybenzazole fiber, a value U calculated by dividing the apparent crystal size of the surface layer part by the apparent crystal size of the center part is in a range of 0.75 to 1.25.

9. The polybenzazole fiber according to claim 2, wherein with respect to an apparent crystal size of the (010) plane of the polybenzazole crystal calculated from the electron diffraction profile along the equatorial direction in the surface layer part from the surface to 1 μm and an electron diffraction profile along the equatorial direction in a center part of the polybenzazole fiber, a value V calculated by dividing the apparent crystal size of the surface layer part by the apparent crystal size of the center part is in a range of 0.75 to 1.25.

10. The polybenzazole fiber according to claim 8, wherein with respect to an apparent crystal size of the (010) plane of the polybenzazole crystal calculated from the electron diffraction profile along the equatorial direction in the surface layer part from the surface to 1 μm and the electron diffraction profile along the equatorial direction in the center part of the polybenzazole fiber, a value V calculated by dividing the apparent crystal size of the surface layer part by the apparent crystal size of the center part is in a range of 0.75 to 1.25.

11. The polybenzazole fiber according to claim 10, wherein a cross-section of the polybenzazole fiber is composed of a sheath layer and a core layer distinguished by an optical microscope and a ratio R (%) of an average diameter $r_2$ of the core layer to a diameter $r_1$ of the entire cross-section of the fiber is 90% or lower.

* * * * *